US005484312A

United States Patent [19]

Zepeda

[11] Patent Number: 5,484,312

[45] Date of Patent: Jan. 16, 1996

[54] SURFBOARD FOOT PIECE

[76] Inventor: Jesse G. Zepeda, 4644 Spruce, Bellaire, Tex. 77401

[21] Appl. No.: 278,832

[22] Filed: Jul. 22, 1994

[51] Int. Cl.[6] ..... B65B 35/79

[52] U.S. Cl. ..... 441/74

[58] Field of Search ..... 441/70, 74, 75; 114/39.2; 280/18, 607

[56] References Cited

U.S. PATENT DOCUMENTS 3,370,818 2/1968 Lear ..... 114/343

4,592,734 6/1986 Mentiver ..... 441/74

4,822,310 4/1989 Parker et al. ..... 441/70

*Primary Examiner*—Sherman Basinger

*Attorney, Agent, or Firm*—Bill B. Berryhill

[57] ABSTRACT

An improved foot piece for attachment to a surfboard. The foot piece has an elongated fin-like body having an elongated flat base for attachment to the deck of the surfboard. Inner and outer side surfaces project upwardly from the base and curve in the same direction terminating in a tip. The inner side surface and the adjoining deck provide a laterally unobstructed curved pocket for lateral engagement by the medial side of a surfer's foot.

9 Claims, 1 Drawing Sheet

SURFBOARD FOOT PIECE

BACKGROUND OF THE INVENTION

1. Field of the Invention

The present invention pertains to surfboards. More specifically, the present invention pertains to foot pieces for attachment to surfboards to provide more control and maneuverability thereof.

2. Description of the Prior Art

Surfing has become a very popular water sport. Typical surfboards are long, narrow buoyant boards having a bow-shaped nose section and a stern shaped tail section. The upper surface of the surfboard is usually referred to as the deck. The surfboard may also be provided with a fin projecting downwardly from the lower surface thereof.

The surfboard user typically stands on the deck of the surfboard with one foot planted near the tail section and the forward or leading foot planted somewhere midway of the surfboard or slightly toward the nose section thereof. The feet are positioned somewhat transversely of the axis or "stringer" of the surfboard. The surfboard is controlled by placement of the feet and shifting of the surfer's body.

With the increased popularity of surfing, surfers are attempting more spectacular and difficult maneuvers. In fact, experienced surfers can perform acrobatics and aerial maneuvers off the face of a wave. To perform some of these maneuvers, various means of providing additional traction and/or foot control, so the surfer may maintain his balance control and traction with the deck while performing aerials and other difficult maneuvers, have been developed.

In some surfboard designs, the deck surface of the surfboard is simply provided with a friction increasing material which is engageable by the sole of the surfer's foot to prevent the foot from slipping off of the board. An example of such is shown in U.S. Pat. No. 4,840,590. While such designs create additional traction and improve control of the surfboard, they provide little to the balance, control and maneuverability required for acrobatic and aerial movements.

Other surfboard designs provide foot pieces in the form of a fixed loop or stirrup in which the surfer's foot can be placed. Examples of such foot pieces are shown in U.S. Pat. Nos. 4,592,734; 4,645,466; 4,775,345; 4,960,063; 5,018,468; and 5,167,553. While these loop or stirrup designs substantially increase the control necessary for performing acrobatic and aerial movements, they are not without disadvantages and limitations. The loop or stirrup foot piece, being fixed, secures the board to the user's foot and restricts the user's foot movement. Furthermore, mounting and dismounting of the board while riding waves is more difficult with loops or strings. Other designs, attempt to provide the same maneuverability of foot loops without the restriction of foot movements. Such a design is shown in U.S. Pat. No. 4,990,113 in which a hand loop or grip is provided. However, this requires the user to stoop or bend to grab the hand loop and restricts movement of his body.

Most, if not all, of the foot loop and stirrup or hand loop designs project upwardly from the surfboard deck in a rather obtrusive manner so that if the user simply wants to lie flat on the board while swimming to catch the next wave, these obtrusive foot and hand pieces are quite uncomfortable. Thus, it is obvious that with the continued development of surfboards and increased popularity of surfing, increasingly sophisticated designs are sought. Designs with foot pieces which provide greater control, maneuverability and flexibility continue to be desired.

SUMMARY OF THE PRESENT INVENTION

The present invention provides an improved foot piece for attachment to the deck of a surfboard. The foot piece comprises an elongated fin-like body having an elongated flat base for attachment to the deck of a surfboard and upwardly projecting inner and outer side surfaces both of which curve in the same direction and terminate in an elongated tip. The fin-like body, in cross-section, curves in one direction so that the inner side surface, in cooperation with the adjoining deck of the surfboard, forms an unobstructed pocket for lateral engagement with a medial side of one of a surfboard user's foot. In a preferred embodiment, there are two foot pieces attached to the surfboard deck. One is attached nearer the tail section and the other nearer the nose section, the pocket of the first foot piece opening toward the tail section and the pocket of the second foot piece opening toward the nose section.

Thus, the foot piece of the present invention provides both the advantages of a traction foot step and an aerial foot piece. The foot piece of the present invention allows the surfer to lift and control the board to execute difficult acrobatic and aerial maneuvers and to do so more consistently. Difficult movements, such as three hundred sixty degree aerial turns are made possible.

Since the pocket formed by the foot piece of the present invention is engageable by the foot but does not completely encircle the foot, it allows much greater freedom of movement and actually allows the foot to be easily removed when falling or when the surfer desires to lie flat on the surfboard in swimming back to catch the next wave. In addition, since the foot piece is of a resilient material, the foot piece may be forced against the board by the body so as not to be as uncomfortable as designs of the prior art.

The foot piece of the present invention can be mounted at any desired position on the surfboard. Furthermore, it can be mounted in a more or less correct position so that beginners can more easily learn to surf. Other objects and advantages of the invention will be apparent from reading the description which follows in conjunction with the accompanying drawings.

DESCRIPTION OF A PREFERRED EMBODIMENT

Figure 1:
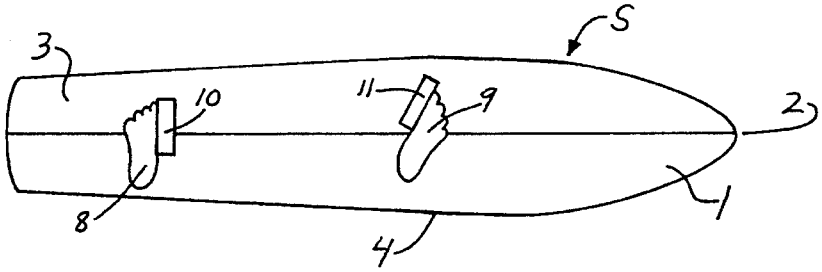
FIG. 1 is a plan view of a surfboard equipped with foot pieces, according to preferred embodiments of the invention, and showing placement of a surfer's feet thereon.
Figure 2:
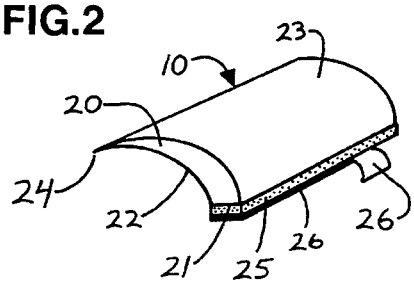
FIG. 2 is a perspective view of a foot piece of the present invention, according to a preferred embodiment thereof.

Referring first to FIG. 1, there is shown the upper surface or deck 1 of a surfboard S having a nose section 2 and a tail section 3. There is a rail section 4 along one side of the surfboard, a stringer 5 along the longitudinal axis of the surfboard. Foot pieces 10 and 11 are attached to the deck of the surfboard for engagement with the feet 8,9 of a surfer. One foot piece 10 is mounted near the tail section 3 of the surfboard for engagement by the medial side of one of the surfers feet 8 (the left foot in this case). The other foot piece 11 is mounted nearer the nose section 2 for engagement by the medial side portion of the other foot 9 (the right foot in this case).

Figure 3:
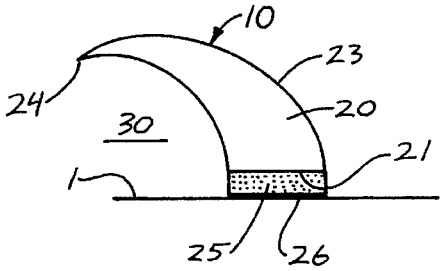
FIG. 3 is an end view of the foot piece of FIG. 2, according to a preferred embodiment of the invention.
Figure 4:
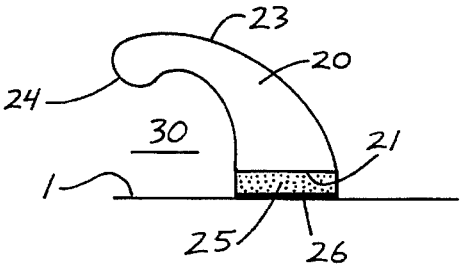
FIG. 4 is an end view of a foot piece of the present invention, according to an alternate embodiment thereof.

Referring also now to FIG'S. 2 and 3, the foot piece 10 (also the foot piece 11) has an elongated fin-like body 20 with an elongated flat base 21 and upwardly projecting inner and outer side surfaces 22,23, respectively, both of which curve in the same direction, terminating in an elongated tip 24 so that the fin-like body 20, when viewed in cross-section as in FIG. 3, curves toward one direction. The radius of curvature of the outer side surface 23 is greater than the radius of curvature of the inner side surface 22 and the thickness or the width of the body decreases from its base 21 toward its tip 24. As shown in FIG. 4, the tip 24 could be thicker or provided with a rounded or bulbous shape.

Figure 5:
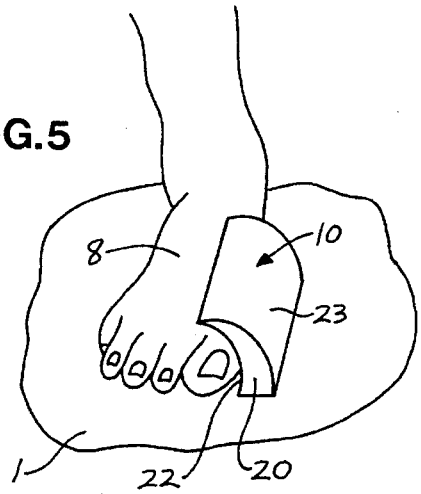
FIG. 5 is a pictorial illustration of a foot piece of the present invention showing a surfer's foot engaged therewith.

The flat base 21 of the foot piece if preferably provided with an adhesive material 25 covered by a layer of protective material 26. Removal of the protective material 26 allows the flat base of the foot piece 10 to be placed against the surfboard deck and attached thereto in any selected position thereon. When attached to the surfboard, the inner side surface 22 and the adjoining portion of the surfboard deck 1 forms a laterally unobstructed pocket 30 for lateral engagement with the medial side of the surfboard user's foot 8. (See FIGS. 3, 4 and 5). The term "laterally unobstructed", as applied to the pocket 30, is intended to describe the fact that as the foot 8 moves laterally; i.e., perpendicular to the length of the foot, as illustrated by arrow 31 in FIG. 5, movement of the foot 8 and lateral engagement of the medial side of the foot 8 with the pocket 30 is totally unimpeded. This allows mounting and dismounting of the surfboard S in the quickest and easiest manner possible.

Figure 6:
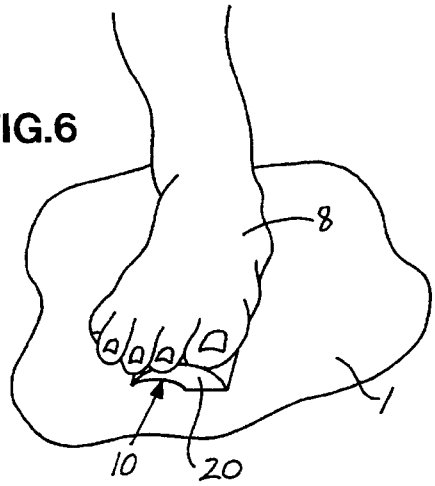
FIG. 6 is a pictorial view of a foot piece, according to a preferred embodiment of the invention, showing the foot piece forced down against the deck of a surfboard with the sole of the user's foot thereon.

The foot pieces 10,11 are preferably of a rubber-like or resilient material so that when a force is applied to the outer surface 23 thereof, the fin-like body will be deformed, such as illustrated in FIG. 6, so that the tip will be forced downwardly toward the surfboard deck 1 providing an elongated curved surface for engagement by the sole of the user's foot as shown in FIG. 6. This also allows the foot piece to be pressed down against the deck by the surfer's knee for certain maneuvers or by the surfer's body when the surfer is lying flat on the surfboard swimming to catch the next wave.

Thus, the foot piece of the present invention provides a foot piece which provides traction, balance, control and maneuverability in a combination not provided by the prior art. Furthermore, the foot piece of the present invention allows mounting and dismounting of a surfboard in the easiest and quickest possible manner. While a preferred embodiment and several variations have been mentioned herein, many variations of the invention can be made without departing from the spirit of the invention. Accordingly, it is intended that the scope of the invention be limited only by the claims which follow.

I claim:

1. An improved foot piece for attachment to a surfboard, said foot piece comprising an elongated fin-like body having an elongated flat base for attachment to the deck of said surfboard and upwardly projecting inner and outer side surfaces both of which curve in the same direction and terminate in an elongated tip so that said fin-like body, when viewed in cross section, curves toward said one direction and decreases in width from said base toward said tip, said inner side surface providing in cooperation with said surfboard deck a laterally unobstructed curved pocket for unobstructed lateral engagement by the medial side of a surfboard users foot, said elongated tip being and remaining free of any attachments so that during use lateral movement of said users foot into and out of engagement and with said curved pocket is totally unimpeded.

2. An improved surfboard foot piece as set forth in claim 1 in which the radius of curvature of said outer side surface is greater than the radius of curvature of said inner side surface.

3. An improved surfboard foot piece as set forth in claim 1 in which said foot piece body is of a resilient material so that when a force is applied to said foot piece by said users foot, from said outer side surface, said fin-like body will be deformed so that said free tip will be forced toward the deck of said surfboard so that said outer side surface then provides an elongated curved surface for engagement by the sole of said users foot.

4. An improved surfboard foot piece as set forth in claim 1 in which said flat base is provided with an adhesive material covered by a layer of protective material, removal of said protective material allowing said foot piece to be attached to said surfboard deck by placing said flat base against said deck in a selected position thereon.

5. In combination with a surfboard a foot piece having an elongated fin-like body the base of which is flat and attached to the deck of said surfboard, said fin-like body being further defined by upwardly curving and projecting inner and outer surfaces both of which curve in the same direction and terminate in an elongated which is free of any attachments tip so that said fin-like body, in cross-section, curves toward said same direction, said inner side surface, in cooperation with the adjoining deck of said surfboard, forming a laterally unobstructed pocket for unobstructed lateral engagement with the medial side of one of a surfboard users foot, said elongated tip being and remaining free during use so that lateral movement of said users foot into and out of engagement with said pocket is totally unimpeded.

6. The combination of claim 5 in which there are two of said foot pieces attached to said surfboard deck, the first nearer the tail section of said surfboard and the second nearer the nose section of said surfboard, the pocket of said first foot piece opening substantially toward said tail section and the pocket of said second foot piece opening substantially toward said nose section, the tips of both foot pieces remaining free of attachments and each of said pockets being laterally unobstructed for unimpeded lateral engagement and disengagement by medial sides of respective feet of the user.

7. The combination of claim 6 in which the width of said fin-like body of each of said foot pieces gradually decreases from said base toward said tip.

8. The combination of claim 6 in which the radius of curvature of said outer side surfaces of each of said foot pieces is greater than the radius of curvature of said inner side surfaces thereof.

9. The combination of claim 6 in which at least one of said foot pieces is of a resilient material so that when a force is applied to said outer surface thereof, said fin-like body will be deformed so that said free tip will be forced downwardly toward said surfboard deck.

* * * * *